United States Patent [19]

Jolly

[11] Patent Number: 4,679,344

[45] **Date of Patent: * Jul. 14, 1987**

[54] GUN SIGHT

[76] Inventor: Thomas A. Jolly, 352 Loma Vista, El Segundo, Calif. 90245

[ * ] Notice: The portion of the term of this patent subsequent to Jul. 22, 2003 has been disclaimed.

[21] Appl. No.: 888,589

[22] Filed: Jul. 21, 1986

Related U.S. Application Data

[63] Continuation-in-part of Ser. No. 664,611, Oct. 25, 1984, Pat. No. 4,601,121.

[51] Int. Cl.[4] ..... F41G 1/00

[52] U.S. Cl. ..... 42/100; 42/102; 33/233; 33/241

[58] Field of Search ..... 42/100, 102; 33/241, 33/233

[56] References Cited

U.S. PATENT DOCUMENTS

| | | | |
|---|---|---|---|
| 3,495,338 | 2/1970 | Ullman | 42/100 |
| 4,130,958 | 12/1978 | Gutridge | 42/100 |
| 4,601,121 | 7/1986 | Jolly | 42/100 |

*Primary Examiner*—Deborah L. Kyle
*Assistant Examiner*—Michael J. Carone
*Attorney, Agent, or Firm*—Edward A. Sokolski

[57] ABSTRACT

A gun sight for a weapon such as a hand gun, rifle, shotgun, submachine gun, crossbow or the like. The sight is a unitary member in the case of a gun mounted on the top of the barrel thereof and having a top surface which is the form of either an elongated ellipse in one embodiment or an isosceles trapezoid in the case of another embodiment. The base portion of the sight is attached to the weapon, the top surface forming a ramp which rises linearly from its rear end towards the muzzle end thereof. The raise of the ramp is equal to the minor axis of the ellipse in the case of the elliptical embodiment and to that of the longer of the two short sides of the trapezoid in the case of the trapezoidal embodiment. The top surface of the sight is made of a color to contrast with the intended target or may be made of a luminescent material or an internally illuminated translucent material so that it is clearly visible in dim light.

4 Claims, 12 Drawing Figures

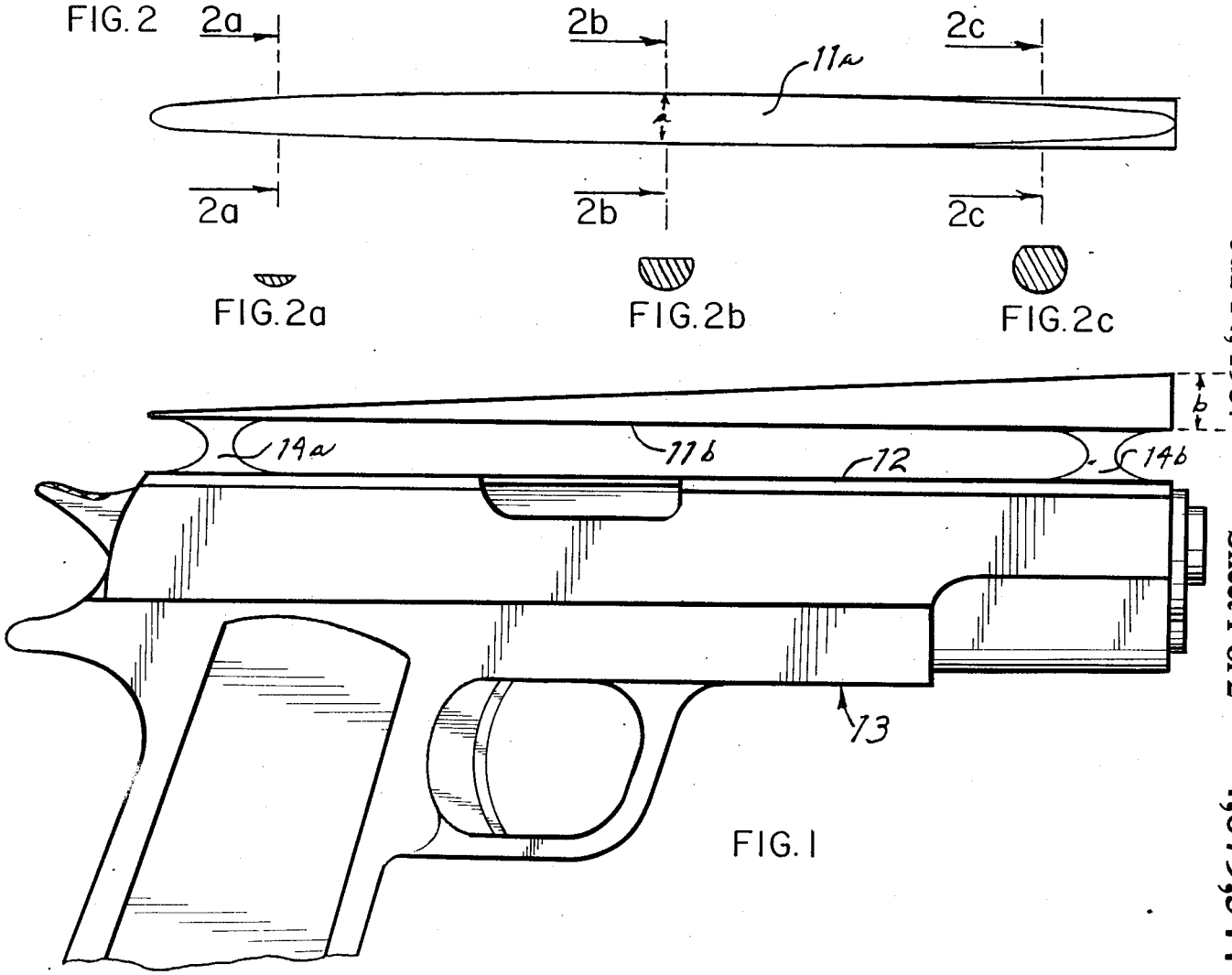
FIG. 2
2a
2a
2b
2b
2c
2c
11a
FIG. 2a
FIG. 2b
FIG. 2c
14a
11b
12
14b
13
FIG. 1
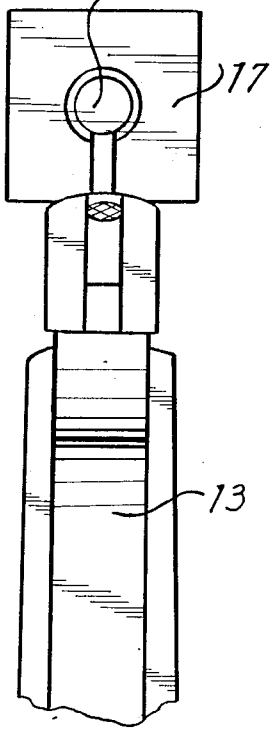
FIG. 3
11
17
13

5a
5b
5c
11a
11b
11c
12
13
14a
14b
17
11

GUN SIGHT

This application is a continuation-in-part of my application Ser. No. 664,611 filed Oct. 25, 1984, U.S. Pat. No. 4,601,121.

This invention relates to a gun sight and more particularly to such a device which is especially suitable for use under unfavorable lighting conditions.

The most commonly used gun sight known as the "post and notch" type sight employs a "post" or "blade" a fraction of an inch in height and thickness which projects upwardly near the muzzle of the gun and is aligned by the shooter with a notch located towards the rear of the gun. In my application Ser. No. 664,611 filed Oct. 25, 1984 of which the present application is a continuation-in-part, an improved gun sight is described which ameliorates and overcomes shortcomings of prior art gun sights. This is achieved by doing away with conventional front and rear sight members and employing a single sight in the form of an elongated triangle which is inclined and tapers to its apex towards the muzzle so that the shooter is presented with a view of an inclined plane in the form of an equilateral triangle. This sight member is attached to the top surface of the gun or other weapon and has a top surface in the form of an elongated isosceles triangle with its apex towards the muzzle of the gun and inclined upwardly in the direction of the muzzle in the form of a ramp. The top surface of the sight is of a color which contrasts with the intended target or is luminescent or may be of an internally illuminated translucent or transparent material so that it is readily visible under low light conditions. In this prior invention the base of the elongated isosceles triangle is made substantially equal to a side of an equilateral formed at the muzzle end of the sight such that with the sight properly aimed at a target the shooter will see the face of the sight as an equilateral triangle with the apex in line at the point on the target at which the projectile will impact. The devices of the present invention are modifications of the invention of the aforementioned prior application and employ the same basic principles of this prior invention. Rather, however, than employing a top surface in the form of an elongated isosceles triangle, in one embodiment an elongated elliptical form is employed for the top surface and in another embodiment an isosceles trapezoidal form is utilized.

Briefly described, the first embodiment of the present invention employs a sight member attached to the top surface of the gun which has a top surface in the form of an elongated ellipse which is inclined upwardly in the direction of the muzzle in the form of a ramp. The top surface of the sight is usually made of a color which contrasts with the intended target or is luminescent or of an internally translucent or transparent material so that it is readily visible under low light conditions. The minor axis of the ellipse is substantially equal to the rise of the ramp. With the sight properly aimed at the target, the shooter will see the face of the sight as a circle superimposed on the target. Errors in aiming result in the sight appearing to the shooter as an ellipse rather than a circle.

In the second embodiment the sight member is similar in basic structure to that of the first embodiment except that the top surface is in the form of an isosceles trapezoid. The elongated sides of which if extended, would converge at the eye of the shooter (typically two feet behind the rear end of the sight). With the sight properly aimed at the target, the shooter will see the face of the sight as a square superimposed on the target. Errors in aiming result in the sight appearing to the shooter as a rectangle or rhombus rather than a square. This sighting configuration allows hand gun target shooters to use an aiming technique known as "squaring the bull's-eye" which has been usable only by rifle shooters heretofore. This technique permits the square front sight to be referenced upon the square outline of the target frame rather than against the circular bull's-eye. This technique circumvents the tendency of the bull's-eye and front sight to "bleed" into each other.

It is therefore an object of the invention to provide a novel gun sight which is particularly useful in low light conditions.

It is a further object of this invention to provide an improved gun sight which is easier to aim than prior art sights.

It is a further object of this invention to provide an improved gun sight which is better suited to rapid fire than prior art sights.

Other objects of this invention will become apparent as the description proceeds in connection with the accompanying drawings of which:

FIG. 1 is a side elevational view of the first embodiment of the invention as mounted on a pistol;

FIG. 2 is a top plan view of the first embodiment of the invention;

FIG. 2A is a cross sectional view taken along the plane indicated by 2A—2A in FIG. 2;

FIG. 2B is a cross sectional view taken along the plane indicated by 2B—2B in FIG. 2;

FIG. 2C is a cross sectional view taken along the plane indicated by 2C—2C in FIG. 2;

FIG. 3 is an illustrative view showing the use of the first embodiment in properly aiming at a target;

Figures 4, 5, 5A, 5B, 5C, 6:
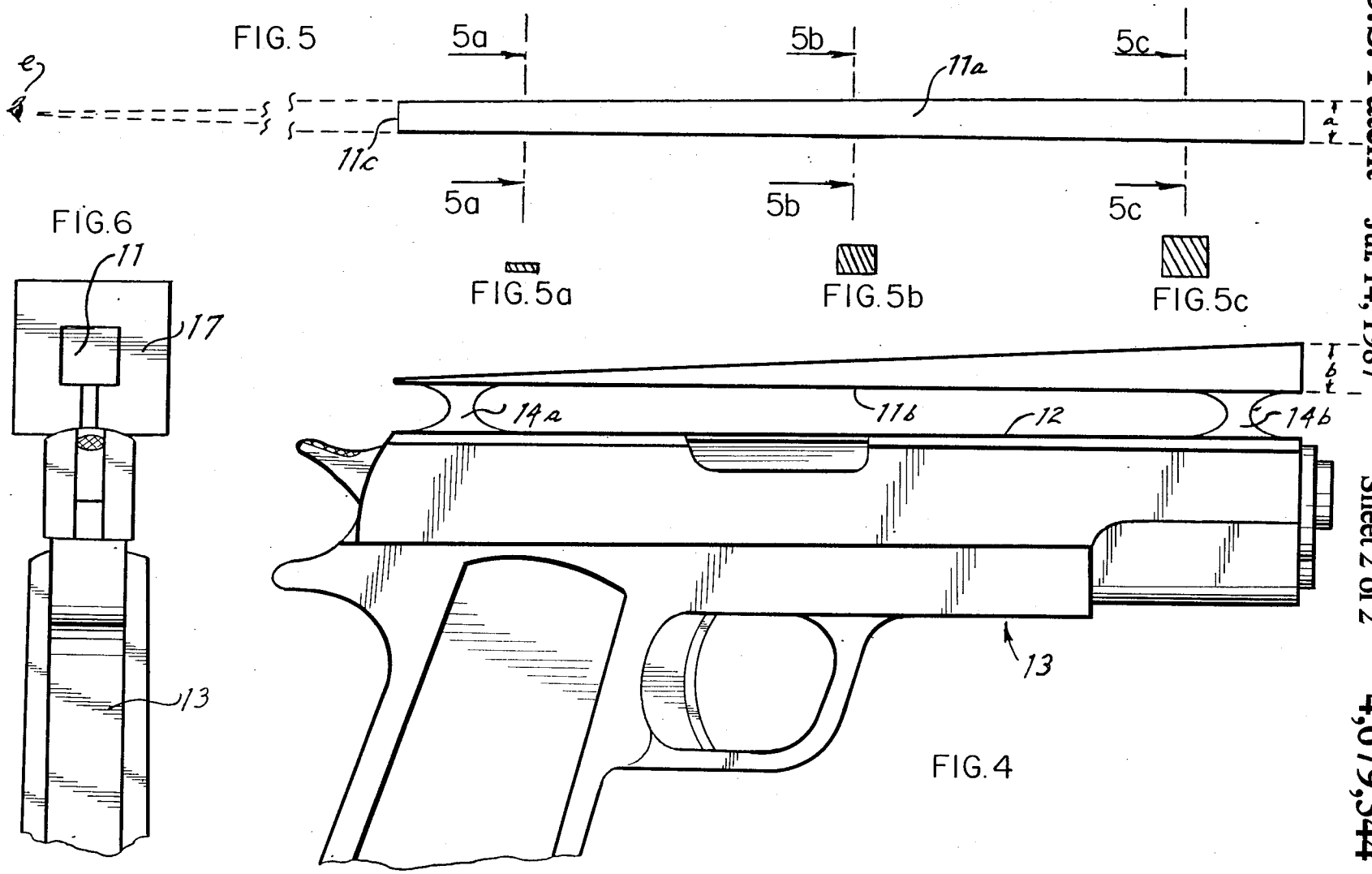
FIG. 4 is a side elevational view illustrating a second embodiment of the invention incorporated as a sight for a pistol.
FIG. 5 is a top plane view of the second embodiment.
FIG. 5A is a cross sectional view taken along the plane indicated by 5A—5A in FIG. 5.
FIG. 5B is a cross sectional view taken along the plane indicated by 5B—5B in FIG. 5.
FIG. 5C is a cross sectional view taken along the plane indicated by 5C—5C in FIG. 5.
FIG. 6 is a pictorial illustration illustrating the use of the second embodiment in properly aiming a gun on a target.

Referring now to FIGS. 1, 2 and 2A–2C, a first embodiment of the invention is illustrated. The sight 11 of the first embodiment is mounted on the top surface 12 of hand gun 13 by means of a pair of mounts **14*a* and 14*b*. Mounts 14*a* and 14*b* may be formed integrally with the base portion 11*b* of the sight or may be screwed, brazed or soldered thereto and also may be screwed, brazed or soldered to the barrel of the gun. Top surface 11*a* of the sight is essentially flat and rises linearly towards the muzzle end of the gun. The top surface 11*a* of the sight is in the form of an elongated ellipse having a minor axis "a" which is equal to the rise "b" of the ramp formed by the sight. The top surface 11*a*** is of a color to contrast with the intended target or of luminescent material or illuminated so that it is readily visible under low light conditions.

Referring now to FIG. 3, when the gun is properly aimed at the target, the shooter will see the sight 11 as a perfect circle superimposed on the target 17. Errors in aiming will result in the sight appearing to the shooter as an ellipse rather than a circle.

Referring now to FIGS. 4, 5 and 5A–5C, a second embodiment of the invention is shown. The sight 11 is supported on the top surface 12 of gun 13 by means of mounts 14*a* and 14*b* in the same manner as described for the first embodiment. The top surface 11*a* of the sight in this instance rather than being elliptical is in the form of an isosceles trapezoid. The longer sides of this trapezoid are made to have a length such that if extended they would converge at the eye "e" of the shooter (usually about two feet from the rear end 11*c* of the sight). The longer of the two shorter sides of the trapezoid, indicated by "a" in FIG. 5, is equal in length to the rise "b" of the ramp formed by the sight. As shown in FIG. 6, with the weapon properly aimed at the tarpet, the sight 11 will appear as a square centered on target 17. When the gun is not properly aimed the sight will appear as a rectangle or a rhombus.

The device of the present invention thus provides a simple yet highly effective gun sight which greatly facilitates accurate shooting and is particularly useful in situations of low light or poor visibility. The devices of the present invention employ the same basic concept as that of my prior application Ser. No. 664,611 of which the present application is a continuation-in-part and which prior application is incorporated herein by reference.

While the invention has been described and illustrated in detail, it is to be clearly understood that is intended by way of illustration and example only and is not to be taken by way of limitation, the spirit and scope of this invention being limited only by the terms of the following claims.

I claim:

1. A gun sight for mounting on a gun having a muzzle, barrel and top surface, said sight comprising:

a base portion attached to the top surface of said gun;

a top portion in the form of an elongated ellipse, said top portion rising linearly towards the muzzle of the gun;

said top portion rising a distance substantially equal to the minor axis of said ellipse;

whereby when a target is sighted along said top portion of the sight, the gun is properly aimed when a circle centered on the target appears in the sight.

2. The gun sight of claim 1 wherein said top portion is in the form of a substantially flat surface.

3. A gun sight for mounting on a gun having a muzzle, barrel and top surface, said sight comprising:

a base portion attached to the top surface of said gun;

a top portion in the form of an elongated isosceles trapezoid;

said trapezoid having a pair of opposing parallel sides which are of unequal length, the longer of said opposing shorter sides being located towards the muzzle end of the gun;

said top portion rising a distance substantially equal to the longer of said shorter sides;

whereby when a target is sighted along said top portion of the sight, the gun is properly aimed when a square centered on the target appears in the sight.

4. The gun sight of claim 3 wherein said top portion is in the form of a substantially flat surface.

* * * * *